US012503848B1

(12) United States Patent
Workman et al.

(10) Patent No.: US 12,503,848 B1
(45) Date of Patent: Dec. 23, 2025

(54) INSULATED DRY-STACKED BLOCK WALL SYSTEM

(71) Applicant: Endura Systems LLC, Draper, UT (US)

(72) Inventors: Brandon Workman, South Jordan, UT (US); Shane Westmoreland, Lindon, UT (US); Austin Westmoreland, Provo, UT (US); Brent Ostler, Provo, UT (US)

( * ) Notice: Subject to any disclaimer, the term of this patent is extended or adjusted under 35 U.S.C. 154(b) by 0 days.

(21) Appl. No.: 19/268,113

(22) Filed: Jul. 14, 2025

(51) Int. Cl.
*E04B 5/04* (2006.01)
*E04B 2/42* (2006.01)
*E04B 2/02* (2006.01)

(52) U.S. Cl.
CPC ..... *E04B 2/42* (2013.01); *E04B 2002/0243* (2013.01); *E04B 2002/0293* (2013.01)

(58) Field of Classification Search
CPC ..... E04B 2/42; E04B 2002/0243; E04B 2002/0293
See application file for complete search history.

(56) References Cited

U.S. PATENT DOCUMENTS 943,518 A * 12/1909 Butz ..... F16L 9/18 52/505
1,441,156 A * 1/1923 Kindstrom ..... E04B 2/42 52/592.4
1,444,167 A * 2/1923 Cooper ..... E04B 2/42 52/125.3
1,447,041 A * 2/1923 Roeth ..... E04B 2/42 52/505
2,157,992 A * 5/1939 Smith ..... E04B 2/28 52/427
2,185,196 A * 1/1940 Heath ..... E04B 2/14 52/428
2,852,933 A * 9/1958 Amundson ..... E04B 2/42 428/188
4,748,782 A 6/1988 Johnson et al.
4,769,964 A 9/1988 Johnson et al.
4,854,097 A * 8/1989 Haener ..... E04C 1/41 52/505
5,209,037 A * 5/1993 Kennedy ..... E04C 1/41 52/612
5,355,647 A 10/1994 Johnson et al.
6,679,022 B1 * 1/2004 Corporaal ..... E04B 2/08 52/592.5
7,882,674 B2 * 2/2011 Craven ..... E04C 1/397 446/124

(Continued)

FOREIGN PATENT DOCUMENTS

CA 1296541 C 3/1992

*Primary Examiner* — Basil S Katcheves

(57) ABSTRACT

An insulated dry-stacked block wall system includes an exterior structure coat, an interior structure coat, insulation inserts, and blocks, the insulation inserts and blocks being interposed between the exterior structure coat and the interior structure coat. The blocks may mate with the insulation inserts. The blocks may include a right-corner block, a left-corner block, a stretcher block, and a half-stretcher block. The blocks may include notches that are configured to interact with the insulation inserts and increase the strength of the system. The blocks may further include apertures that are fully surrounded by side walls in some embodiments.

18 Claims, 12 Drawing Sheets

(56) References Cited

U.S. PATENT DOCUMENTS

| | | | | |
|---|---|---|---|---|
| 9,482,003 | B2 * | 11/2016 | Browning | E04B 2/14 |
| 11,091,911 | B1 * | 8/2021 | Schnabel | E04B 2/42 |
| 2008/0060300 | A1 * | 3/2008 | Westmoreland | E04B 2/8629 52/405.4 |
| 2008/0104916 | A1 * | 5/2008 | Schmid | E04C 1/41 52/745.19 |
| 2014/0260029 | A1 * | 9/2014 | Browning | E04B 1/04 52/564 |
| 2017/0145690 | A1 * | 5/2017 | Genest | E04C 1/39 |

* cited by examiner

INSULATED DRY-STACKED BLOCK WALL SYSTEM

CROSS-REFERENCE TO RELATED APPLICATIONS

Not applicable.

TECHNICAL FIELD

The present disclosure relates to a wall system. More particularly, the present disclosure relates to a wall building system that improves structural integrity and energy efficiency for a structure.

BACKGROUND

Building has been an important part of human history since the dawn of man. These structures have varied in materials, size, and build quality. Some of the structures were built using animal hides, leaves, branches, mud and grasses, stones, clay, and timber. While some of these natural materials are still used today, many people have focused on synthetic materials, such as concrete, metals, plastics, or some combination thereof. Many of the natural materials, as well as man-made materials, could not and cannot withstand heat, rain, snow, etc. Furthermore, natural materials may not be the best materials for regulating heat and cold both internally and externally for a structure. Both natural and synthetic materials have many benefits but also have shortcomings, such as issues with cracking, poor thermal insulation, air leaks, and poor sounds reduction. Natural and synthetic materials used in modern times may not only have these discussed inherent weaknesses, but may also be difficult to handle and use to erect a structure.

For example, contractors today often use wood or steel frame construction to erect structures. There are benefits to both of these options. However, these options may be time-consuming and at times, there may be shortages for lumber and/or steel. In addition, to frame structures correctly takes skill and understanding, meaning employees/contractors have to receive many hours of training to be proficient and efficient at their jobs. In addition, some have turned to modern dry-stack construction, which removes a lot of difficulties and issues found in wood or steel frame construction. Dry-stack construction has been used for many years and still used today but with a modern take and techniques. While current dry-stack methods, forms, and products are useful, there are still shortcomings that lead to delayed builds, frustrations for users, and loss of money. As an example of these shortcomings, current block designs can be easily broken during the building process due to weaknesses in their construction. The current block design can be broken too easily due to insufficient material getting into the block mold during production.

Accordingly, there is a need for a wall system that is energy efficient, has structural integrity, withstands the elements, is simple to install, and decreases noise pollution. The present invention seeks to solve these and other problems.

SUMMARY OF EXAMPLE EMBODIMENTS

In one embodiment, an insulated dry-stacked block wall system comprises an exterior structure coat, an interior structure coat, insulation inserts, and blocks, the insulation inserts and blocks being interposed between the exterior structure coat and the interior structure coat. The blocks may mate with and interact with the insulation inserts. The blocks may include a first right-corner block, a first left-corner block, and a first stretcher block. The blocks may include notches that are configured to interact with the insulation inserts. The blocks may further include apertures that are fully surrounded by side walls.

In one embodiment, the blocks may include a second right-corner block, a second left-corner block, and a second stretcher may be used in the system described above and replace the first right-corner block, the first left-corner block, and the first stretcher block, or may be used in tandem therewith. The blocks may include notches that are substantially v-shaped with a flat bottom so as to increase strength. The blocks may further include apertures that are fully circumscribed by side walls.

In one embodiment, the blocks may include a third right-corner block, a third left-corner block, and a third stretcher that may be used in the system and replace any of the above mentioned blocks, or may be used in tandem. Further, the blocks may include a half-stretcher block.

DETAILED DESCRIPTION OF EXAMPLE EMBODIMENTS

Figure 1:
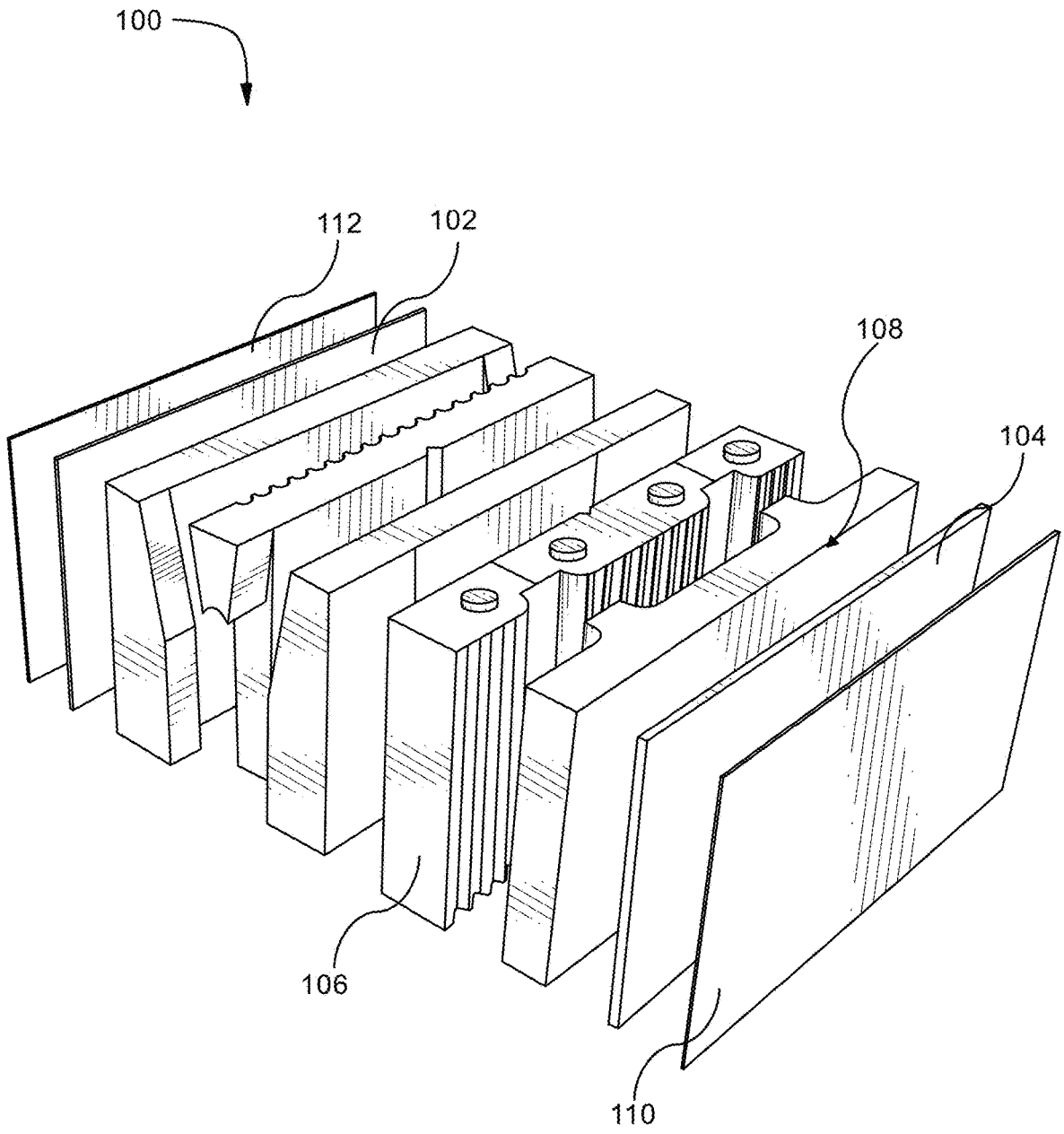
FIG. 1. Illustrates a perspective view of an insulated dry-stacked block wall system.

While embodiments of the present disclosure may be subject to various modifications and alternative forms, specific embodiments have been shown by way of example in the drawings and will be described in detail herein. However, the present disclosure is not intended to be limited to the particular features, forms, components, etc. disclosed. Rather, the present disclosure will cover all modifications, equivalents, and alternatives falling within the scope of the present disclosure.

It will be understood that the detailed description depicts only example embodiments, which are not to be considered limiting in scope. Reference to the invention, the present disclosure, or the like are not intended to restrict or limit the invention, the present disclosure, or the like to exact features or steps of any one or more of the exemplary embodiments disclosed herein. References to "one embodiment," "an embodiment," "various embodiments," and the like, may indicate that the embodiment(s) so described may include a particular feature, structure, or characteristic, but not every embodiment necessarily includes the particular feature, structure, or characteristic. In addition, repeated use of the phrase "in one embodiment," or "in an embodiment," do not necessarily refer to the same embodiment, although they may refer to the same embodiment.

The particular arrangements disclosed herein are meant to be illustrative only and not limiting as to the scope of the invention. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described.

The terms "comprising," "including," "having," and the like, as used with respect to embodiments, are synonymous, and are generally intended as "open" terms.

As previously discussed, there is a need for a wall system that is energy efficient, has structural integrity, withstands the elements, is simple to install, and decreases noise pollution. As such, the present invention seeks to solve these and other problems.

Man has been building structures since the beginning of time. These structures have varied in materials, size, and use over the years. While these structures have changed throughout the years, one thing has remained in common with the earliest structure. That is, these structures are meant to protect and provide desired temperatures for a user. There is some overlap in materials being used today and those used in earlier times. Modern day materials are often a mixture of natural and synthetic materials, so as to get the most efficient materials when it comes to workability, energy efficiency, masking sounds, etc. Many builders today utilize wood framing, insulation, and other materials. Others may use wood, concrete, metals, plastics, insulation, or some combination thereof to erect a structure. When using any of these materials to build a structure, contractors may vary greatly on the approach to using these materials to build. Some approaches may be more cost-effective than others but may not offer the same benefits. In addition, some have turned to modern dry-stack construction, which removes a lot of difficulties and issues found in wood or steel frame construction. Dry-stack construction has been used for many years and still used today but with modern techniques. While current dry-stack methods, forms, and products are useful, there are still shortcomings that lead to delayed builds, frustrations for users, and loss of money. As an example of these shortcomings, current block designs can be easily broken during the building process due to weaknesses in their construction.

The wall system described herein may include an exterior surface, an interior surface, blocks, and insulation. When these components are combined, a user may experience a wall with at least the following benefits: increased structural integrity, increased energy efficiency, water resistance, bug and rodent resistance, increased fire rating, increased noise dampening, and low-maintenance.

As shown in FIG. 1, in one embodiment, an insulated dry-stacked block wall system 100 (hereinafter referred to as the "system") comprises an exterior structure coat 102, an interior structure coat 104, insulation inserts 106, and blocks 108, the insulation inserts 106 and blocks 108 being interposed between the exterior structure coat 102 and the interior structure coat 104. The blocks 108 may mate with and interact with the insulation inserts 106.

The exterior and interior structure coats 102, 104 may be the same or, in some embodiments, may be different. Both the exterior and interior structure coats 102, 104 may be configured to be chemically bonded to outer surfaces of the blocks 108, which provides strength to the block as well as providing a near complete air and water barrier. In some embodiments, the coats 102, 104 may be liquid through the application process to the blocks 108. In other embodiments, the coats 102, 104 may be solid, such as sheets of material that are fastened or adhered to the outer surfaces of the blocks 108. The interior structure coat 104 may be drywall compound, or any other type of interior structure coat. The interior structure coat 104 may be configured to receive an interior finish 110, such as paint or any other interior finish. The exterior structure coat 102 may be configured to receive an exterior finish 112, such as paint, stucco, brick, rock, and/or siding, or any other type of finish.

The insulation inserts 106 may be expanded polystyrene. In other embodiments, the insulation inserts 106 may be polyisocyanurate (polyiso), mineral wool, cellulose insulation, or any other insulation used in the art. The insulation inserts 106 may be configured to be positioned within the blocks 108, or any of the other blocks discussed hereinafter, and help couple each block to its adjacent block. When the insulation inserts are placed in the blocks, they may be secured in cells in the blocks based on fit or interference fit. In other embodiments, the insulation inserts 106 may be secured via an adhesive, fastener, or some other securement mechanism. The insulation inserts 106 may be configured to interlock/secure block horizontally from side to side. It will be appreciated the insulation inserts provide thermal protection as well as sound deadening.

The blocks 108, as shown in FIGS. 2-8, may include a first right-corner block 114A, a first left-corner block 114B, and a first stretcher block 114C. The blocks 108 may be concrete masonry units (CMUs) (i.e., concrete or cinder blocks). In some embodiments, the blocks 108 may be other materials, such as another composite material. The blocks 108 allow for no direct thermal path for heat/cold to travel, which are dry stacked (i.e., mortarless). However, in some embodiments, the blocks 108 may utilize mortar thereinbetween.

Figure 2:
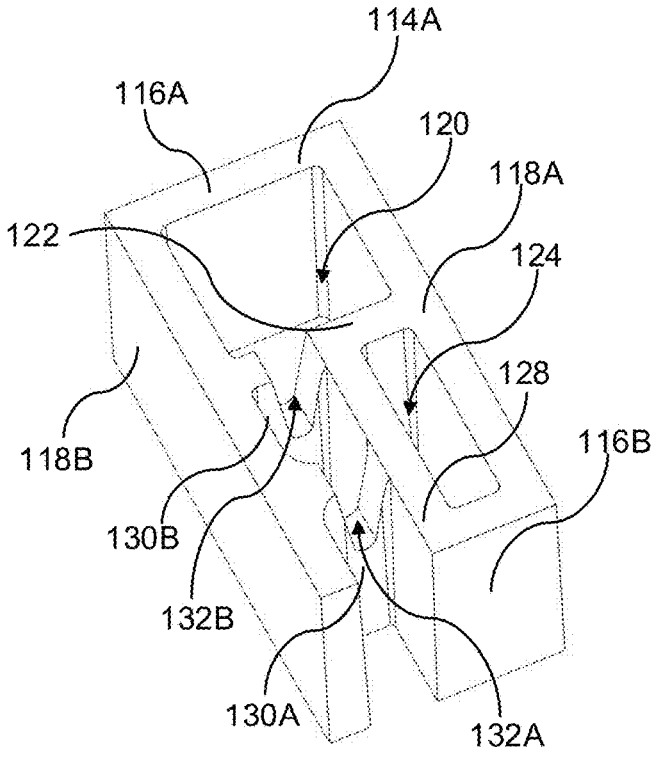
FIG. 2 illustrates a top, side perspective view of a right-corner block of an insulated dry-stacked block wall system.
Figure 3:
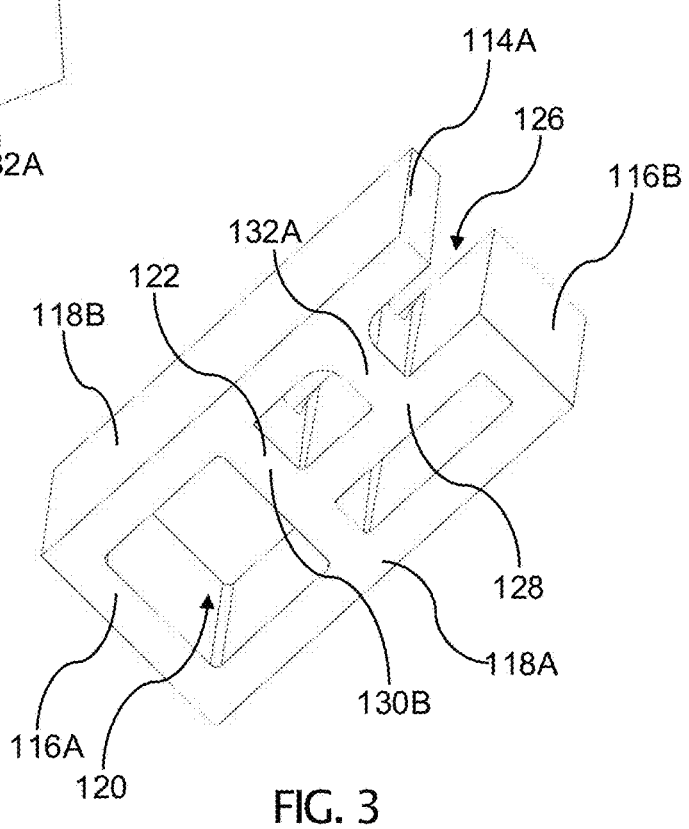
FIG. 3 illustrates a bottom perspective view of a right-corner block of an insulated dry-stacked block wall system.

As shown in FIGS. 2-3, the first right-corner block 114A may include a first right-corner side 116A, a second right-corner side 118A, a third right-corner side 116B, and a fourth right-corner side 118B. Proximate the first right-corner side 116A may be a first right-corner aperture 120 that passes from an upper surface of the first right-corner block 114A to a lower surface thereof. The first right-corner aperture 120 may be generally square-shaped; however, other shapes for the first right-corner aperture 120 could include circular, rectangular, etc. The first right-corner aperture 120 may be defined by the first right-corner side 116A, the second right-corner side 118A, the fourth right-corner side 118B, and partially by a first right-corner inner wall 122. The first right-corner aperture 120 may be configured to receive, for example, rebar or other stabilizing shafts. Interposed between the first right-corner aperture 120 and the third right-corner side 116B may be a second right-corner aperture 124 proximate the second right-corner side 118A and a first right-corner slot 126 proximate the third and fourth right-corner sides 116B, 118B of the right-corner block 114A. The second right-corner aperture 124 may be defined by the second right-corner side 118A, third right-corner side 116B, the first right-corner inner wall 122, and a second right-corner inner wall 128. As such, the second right-corner aperture 124 may be circumscribed by solid walls from the top to the bottom of the second right-corner aperture 124, thereby increasing the strength of the right-corner block 114A. The second right-corner aperture 124 may be generally rectangular in shape; however, in other embodiments, the second right-corner aperture 124 may be circular, square-shaped, etc. The second right-corner aperture 124 may pass from the upper surface of the right-corner block 114A to the lower surface thereof. The first right-corner slot 126 may be opened on the third right-corner side 116B of the right-corner block 114A, meaning the third right-corner side 116B has a gap.

Positioned within the first right-corner slot 126 may be a first right-corner member 130A and a second right-corner member 130B, both of which may be cross-webbings or supports. The first right-corner member 130A may be proximate the third right-corner side 116B and be integrated into the second right-corner inner wall 128 and an inner surface of the fourth right-corner side 118B of the right-corner block 114A. The first right-corner member 130A may be perpendicular to the second right-corner inner wall 128 and the inside of the fourth right-corner side 118B. The first right-corner member 130A may begin at the upper surface of the right-corner block 114A and terminate at the lower surface thereof, with the first right-corner member 130A being flush on the upper and lower surfaces. Further, the first right-corner member 130A may include a first right-corner notch 132A (e.g., a substantially v-shaped notch) with a rounded bottom at the point. The second right-corner member 130B may be proximate and define a portion of the first right-corner aperture 120 and be integrated into the second right-corner inner wall 128 and the inner surface of the fourth right-corner side 118B of the right-corner block 114A. Similar to the first right-corner member 130A, the second right-corner member 130B may be perpendicular to the second right-corner inner wall 128 and the inside of the fourth right-corner side 118B. The second right-corner member 130B may begin at the upper surface of the right-corner block 114A and terminate at the lower surface thereof, with the second right-corner member 130B being flush on the upper and lower surfaces. Further, the second right-corner member 130B may include a second right-corner notch 132B (e.g., a substantially v-shaped notch) with a rounded bottom. In some embodiments, the first and second right-corner notches 132A, 132B may be generally flat at the point of the "V" or bottom thereof, or any other shape. Other embodiments may include a notch that is generally U-shaped or other shapes. The first and second right-corner notches 132A, 132B may increase the strength and integrity of the right-corner block and be configured to receive the insulation inserts 106.

Figure 4:
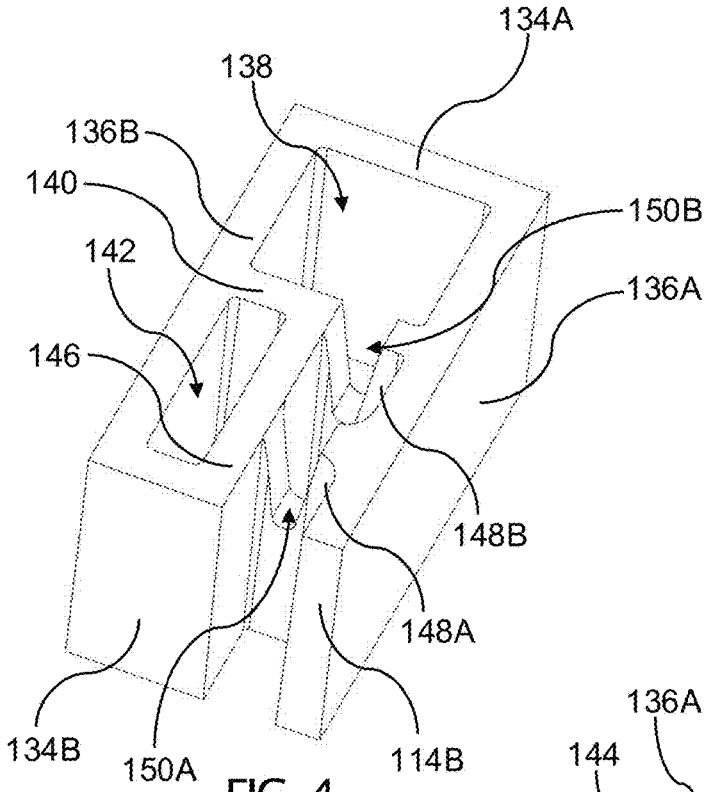
FIG. 4 illustrates a top, side perspective view of a left-corner block of an insulated dry-stacked block wall system.
Figure 5:
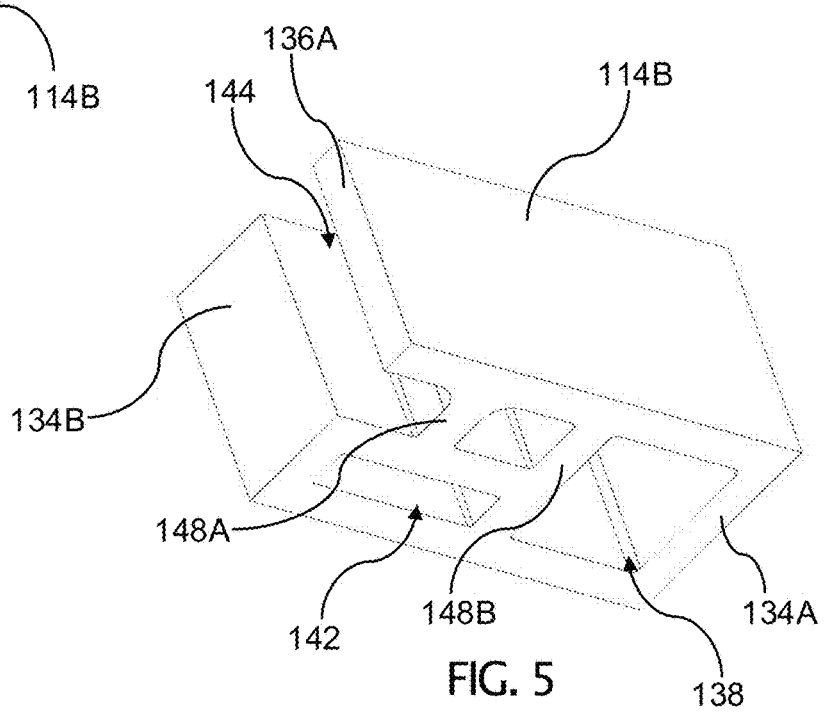
FIG. 5 illustrates a bottom, side perspective view of a left-corner block of an insulated dry-stacked block wall system.

As shown in FIGS. 4-5, similar to the first right-corner block 114A, the first left-corner block 114B may include a first left-corner side 134A, a second left-corner side 136A, a third left-corner side 134B, and a fourth left-corner side 136B. Proximate the first left-corner side 134A may be a first left-corner aperture 138 that passes from an upper surface of the left-corner block 114B to a lower surface thereof. The first left-corner aperture 138 may be generally square-shaped; however, other shapes for the first left-corner aperture 138 could include circular, rectangular, etc. The first left-corner aperture 138 may be defined by the first left-corner side 134A, the second left-corner side 136A, the fourth left-corner side 136B, and partially by a first left-corner inner wall 140. The first left-corner aperture 138 may be configured to receive, for example, rebar or other stabilizing shafts. Interposed between the first left-corner aperture 138 and the third left-corner side 134B may be a second left-corner aperture 142 proximate the fourth left-corner side 136B and a first left-corner slot 144 proximate the second and third left-corner sides 136A, 134B of the first left-corner block 114B. The second left-corner aperture 142 may be defined by the fourth left-corner side 136B, third left-corner side 134B, the first left-corner inner wall 140, and a second left-corner inner wall 146. As such, the second left-corner aperture 142 may be circumscribed by solid walls from the top to the bottom of the second left-corner aperture 142, thereby increasing the strength of the left-corner block 114B. The second left-corner aperture 142 may be generally rectangular in shape; however, in other embodiments, the second left-corner aperture 142 may be circular, square-shaped, etc. The second left-corner aperture 142 may pass from the upper surface of the left-corner block to the lower surface thereof. The first left-corner slot 144 may be opened on the third left-corner side 134B of the left-corner block 114B, meaning the third left-corner side 134B has a gap.

Positioned within the first left-corner slot 144 may be a first left-corner member 148A and a second left-corner member 148B, both of which may be cross-webbings or supports. The first left-corner member 148A may be proximate the third left-corner side 134B and be integrated into the second left-corner inner wall 146 and an inner surface of the fourth left-corner side 136B of the left-corner block 114B. The first left-corner member 148A may be perpendicular to the second left-corner inner wall 146 and the inside of the second left-corner side 136A. The first left-corner member 148A may begin at the upper surface of the left-corner block 114B and terminate at the lower surface thereof, with the first left-corner member 148A being flush on the upper and lower surfaces. Further, the first left-corner member 148A may include a first left-corner notch 150A (e.g., a substantially v-shaped notch) with a rounded bottom. The second left-corner member 148B may be proximate and define a portion of the first left-corner aperture 138 and be integrated into the second left-corner inner wall 146 and the inner surface of the second left-corner side 136A of the left-corner block 114B. Similar to the first left-corner member 148A, the second left-corner member 148B may be perpendicular to the second left-corner inner wall 146 and the inside of the second left-corner side 136A. The second left-corner member 148B may begin at the upper surface of the left-corner block 114B and terminate at the lower surface thereof, with the second left-corner member 148B being flush on the upper and lower surfaces. Further, the second left-corner member 148B may include a second notch 150B (e.g., a substantially v-shaped notch) with a rounded bottom. In some embodiments, the first and second left-corner notches 150A, 150B may be generally flat at the point of the "V" or bottom thereof, or any other shape. Other embodiments may include a notch that is generally U-shaped or other shapes. The notches 132A, 132B, 150A, 150B may increase the strength and integrity of the right- and left-corner blocks 114A, 114B and be configured to receive the insulation inserts 106. In some embodiments, the notches 132A, 132B, 150A, 150B may have a depth of 3". In other embodiments, the depth of the notches 132A, 132B, 150A, 150B may be in more or less than 3", such as a range from 1"-8". While two members are shown in both the corner blocks 114A, 114B, it will be understood that more or less than two members may be used.

Figure 6:
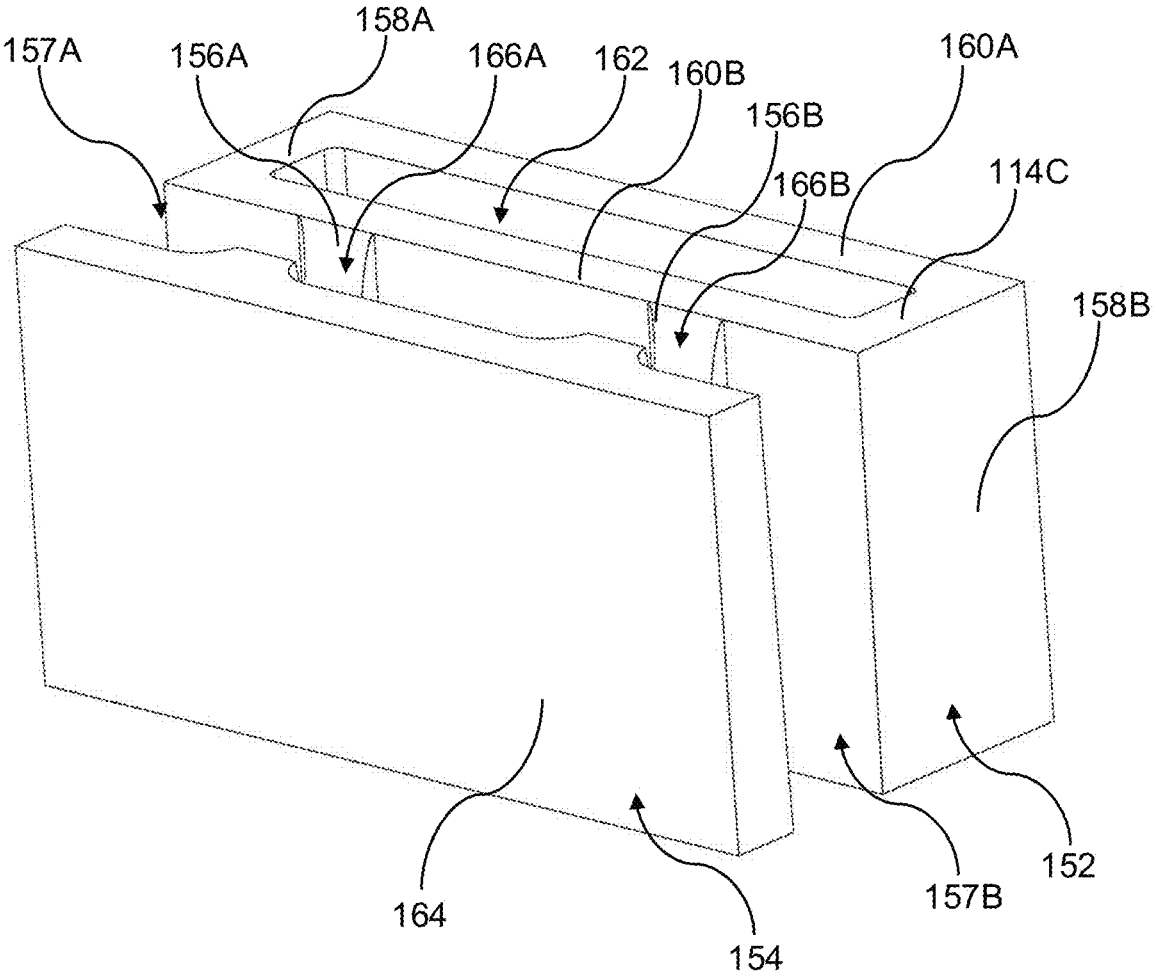
FIG. 6 illustrates a perspective view of a stretcher block of an insulated dry-stacked block wall system.
Figure 7:
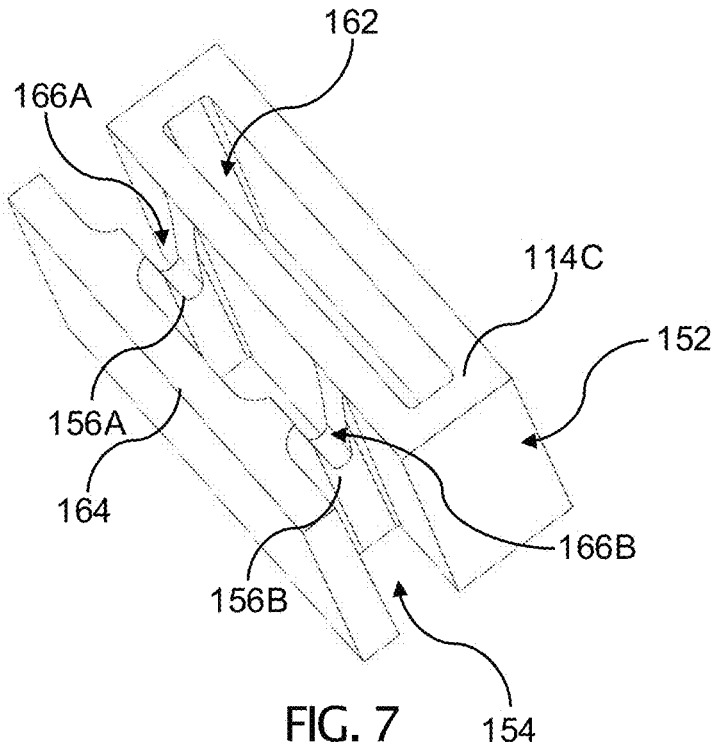
FIG. 7 illustrates a top perspective view of a stretcher block of an insulated dry-stacked block wall system.
Figure 8:
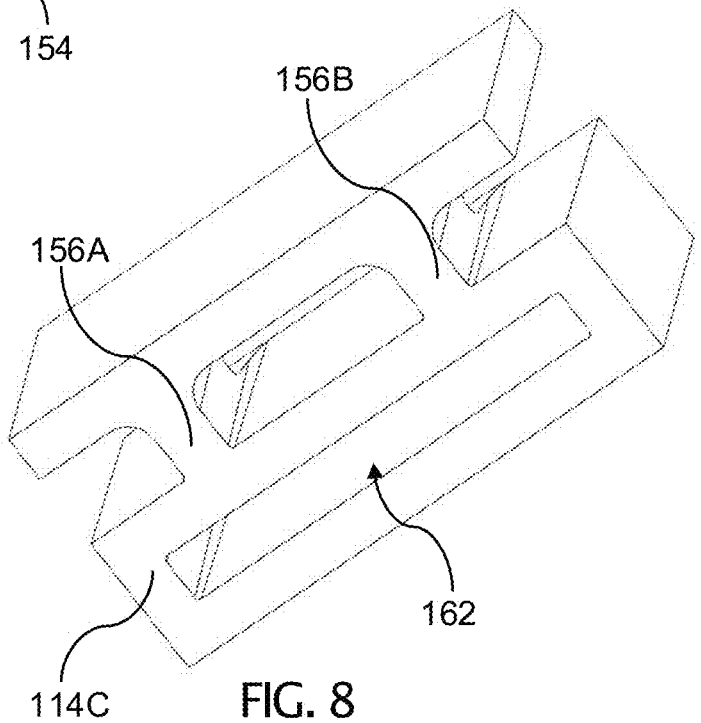
FIG. 8 illustrates a bottom perspective view of a stretcher block of an insulated dry-stacked block wall system.

As shown in FIGS. 6-8, the first stretcher block 114C may include a first section 152 and a second section 154. The first and second sections 152, 154 may be coupled together via a first stretcher member 156A and a second stretcher member 156B, with the stretcher members 156A, 156B being spaced apart by a gap and having on outer sides of both members 156A, 156B channels 157A, 157B. While two stretcher members 156A, 156B are shown, it will be understood that the sections may be coupled with more or less than two stretcher members or may be coupled by another securement mechanism. The first section 152 may include a first stretcher side 158A, a second stretcher side 160A, a third stretcher side 158B, and a fourth stretcher side 160B. The first and third stretcher sides 158A, 158B are parallel to each other while the second and fourth stretcher sides 160A, 160B are parallel to each other. The first, second, third, and fourth stretcher sides/walls 158A, 160A, 158B, and 160B may circumscribe a stretcher block aperture 162 entirely from top to bottom, thereby providing structure to the stretcher block 114C and increased strength when transported and installed. The second section 154 may include a second section panel 164, and as discussed above, may be coupled to the fourth stretcher side 160B via the first and second stretcher members 156A, 156B. Similar to the other members described herein, the first stretcher member 156A may be perpendicular to an inner surface of the fourth stretcher side 160B and an inner surface of the second section panel 164. The first stretcher member 156A may begin at the upper surface of the stretcher block 114C and terminate at the lower surface thereof, with the first stretcher member 156A being flush on the upper and lower surfaces. Further, the first stretcher member 156A may include a first stretcher notch 166A with a rounded bottom. The second stretcher member 156B may be perpendicular to the inner surface of the fourth stretcher side 160B and the inner surface of the second section panel 164. The second stretcher member 156B may begin at the upper surface of the stretcher block 114C and terminate at the lower surface thereof, with the second stretcher member 156B being flush on the upper and lower surfaces. Further, the upper surface may include a second stretcher notch 166B with a rounded bottom. In some embodiments, the first and second stretcher notches 166A, 166B may be generally flat at the point of the "V" or bottom thereof, or any other shape. Other embodiments may include a notch that is generally U-shaped or other shapes. In some embodiments, the notches 166A, 166B may have a depth of 3". In other embodiments, the depth of the notches 166A, 166B may be in more or less than 3", such as a range from 1"-8".

Figure 9:
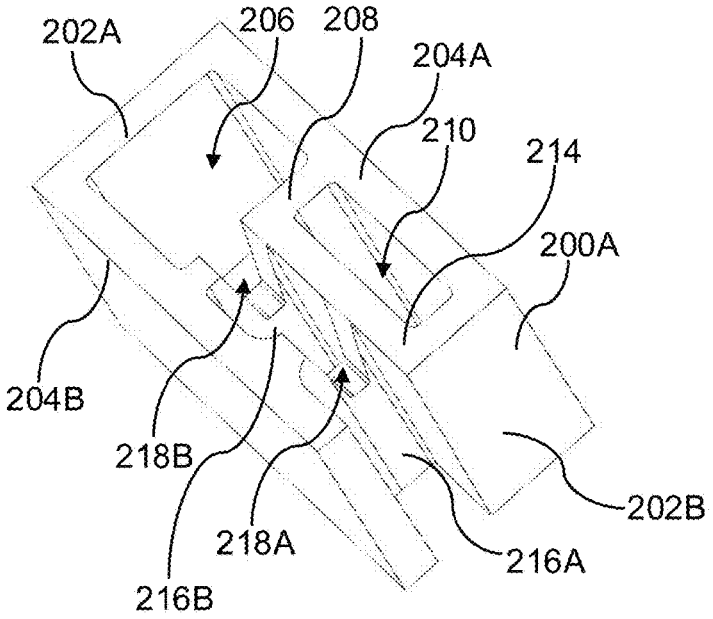
FIG. 9 illustrates a top, side perspective view of a right-corner block of an insulated dry-stacked block wall system.
Figure 10:
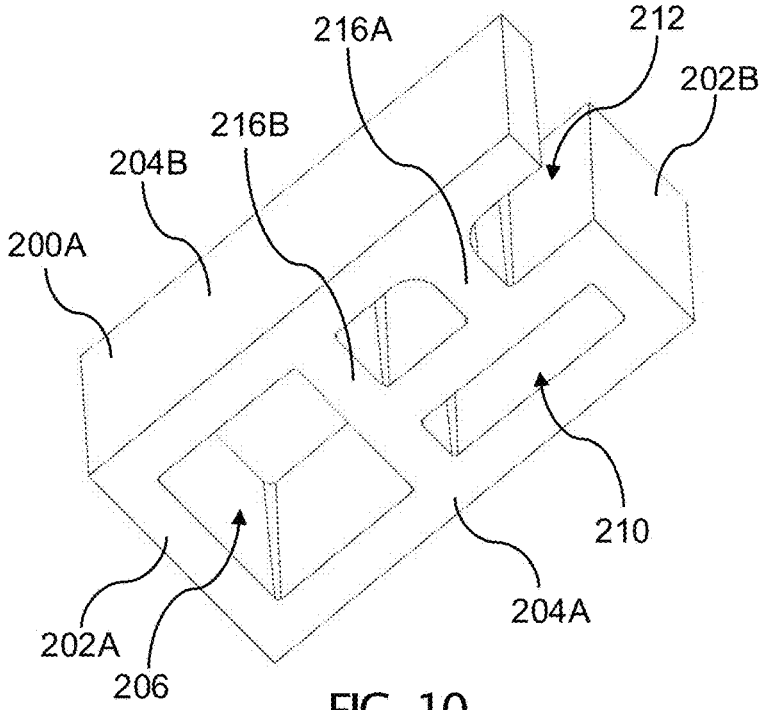
FIG. 10 illustrates a bottom perspective view of a right-corner block of an insulated dry-stacked block wall system.

In one embodiment, as shown in FIGS. 9-14, the blocks 108 (FIG. 1) may include a second right-corner block 200A, a second left-corner block 200B, and a second stretcher block 200C may be used in the system 100 and replace the first right-corner block 114A, the first left-corner block 114B, and the first stretcher block 114C, or may be used in tandem therewith. Referring to FIGS. 9-10, the second right-corner block 200A may include a first right-corner side 202A, a second right-corner side 204A, a third right-corner side 202B, and a fourth right-corner side 204B. Proximate the first right-corner side 202A may be a first right-corner aperture 206 that passes from an upper surface of the second right-corner block 200A to a lower surface thereof. The first right-corner aperture 206 may be generally square-shaped; however, other shapes for the first right-corner aperture 206 could include circular, rectangular, etc. The first right-corner aperture 206 may be defined by the first right-corner side 202A, the second right-corner side 204A, the fourth right-corner side 204B, and partially by a first right-corner inner wall 208. The first right-corner aperture 206 may be configured to receive, for example, rebar or other stabilizing shafts. Interposed between the first right-corner aperture 206 and the third right-corner side 202B may be a second right-corner aperture 210 proximate the second right-corner side 204A and a first right-corner slot 212 proximate the third and fourth right-corner sides 202B, 204B of the second right-corner block 200A. The second right-corner aperture 210 may be defined by the second right-corner side 204A, third right-corner side 202B, the first right-corner inner wall 208, and a second right-corner inner wall 214. As such, the second right-corner aperture 210 may be circumscribed by solid walls from the top to the bottom of the second right-corner aperture 210, thereby increasing the strength of the right-corner block 200A. The second right-corner aperture 210 may be generally rectangular in shape; however, in other embodiments, the second right-corner aperture 210 may be circular, square-shaped, etc. The second right-corner aperture 210 may pass from the upper surface of the right-corner block 200A to the lower surface thereof. The first right-corner slot 212 may be opened on the third right-corner side 202B of the right-corner block 200A, meaning the third right-corner side 202B has a gap.

Positioned within the first right-corner slot 212 may be a first right-corner member 216A and a second right-corner member 216B, both of which may be cross-webbings or supports. The first right-corner member 216A may be proximate the third right-corner side 202B and be integrated into the second right-corner inner wall 214 and an inner surface of the fourth right-corner side 204B of the right-corner block 200A. The first right-corner member 216A may be perpendicular to the second right-corner inner wall 214 and the inside of the fourth right-corner side 204B. The first right-corner member 216A may begin at the upper surface of the right-corner block 200A and terminate at the lower surface thereof, with the first right-corner member 216A being flush on the upper and lower surfaces. Further, the first right-corner member 216A may include a first right-corner notch 218A (e.g., a substantially v-shaped notch) with a flat bottom. The second right-corner member 216B may be proximate and define a portion of the first right-corner aperture 206 and be integrated into the second right-corner inner wall 214 and the inner surface of the fourth right-corner side 204B of the right-corner block 200A. Similar to the first right-corner member 216A, the second right-corner member 216B may be perpendicular to the second right-corner inner wall 214 and the inside of the fourth right-corner side 204B. The second right-corner member 216B may begin at the upper surface of the right-corner block 200A and terminate at the lower surface thereof, with the second right-corner member 216B being flush on the upper and lower surfaces. Further, the second right-corner member 216B may include a second right-corner notch 218B (e.g., a substantially v-shaped notch) with a flat bottom. The first and second right-corner notches 218A, 218B may increase the strength and integrity of the right-corner block 200A and be configured to receive the insulation inserts 106.

Figure 11:
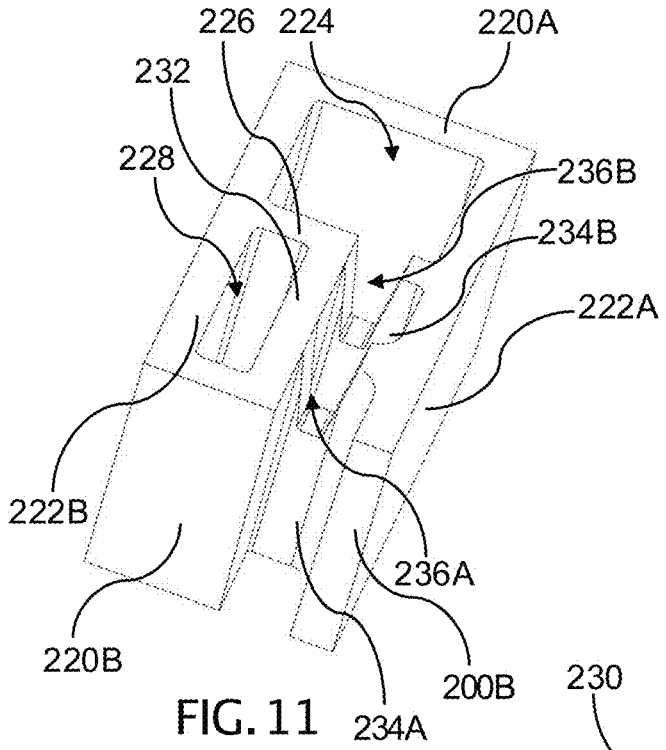
FIG. 11 illustrates a top, side perspective view of a left-corner block of an insulated dry-stacked block wall system.
Figure 12:
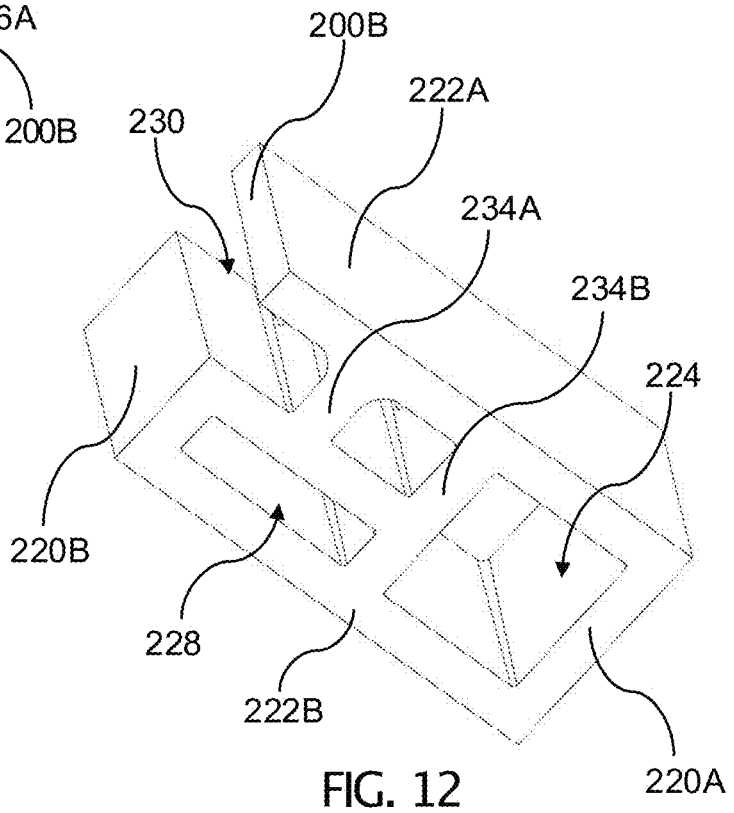
FIG. 12 illustrates a bottom perspective view of a left-corner block of an insulated dry-stacked block wall system.

As shown in FIGS. 11-12, the second left-corner block 200B may include a first left-corner side 220A, a second left-corner side 222A, a third left-corner side 220B, and a fourth left-corner side 222B. Proximate the first left-corner side 220A may be a first left-corner aperture 224 that passes from an upper surface of the left-corner block 200B to a lower surface thereof. The first left-corner aperture 224 may be generally square-shaped; however, other shapes for the first left-corner aperture 224 could include circular, rectangular, etc. The first left-corner aperture 224 may be defined by the first left-corner side 220A, the second left-corner side 222A, the fourth left-corner side 222B, and partially by a first left-corner inner wall 226. The first left-corner aperture 224 may be configured to receive, for example, rebar or other stabilizing shafts. Interposed between the first left-corner aperture 224 and the third left-corner side 220B may be a second left-corner aperture 228 proximate the fourth left-corner side 222B and a first left-corner slot 230 proximate the second and third left-corner sides 222A, 220B of the left-corner block 200B. The second left-corner aperture 228 may be defined by the fourth left-corner side 222B, third left-corner side 220B, the first left-corner inner wall 226, and a second left-corner inner wall 232. As such, the second left-corner aperture 228 may be circumscribed by solid walls from the top to the bottom of the second left-corner aperture 228, thereby increasing the strength of the left-corner block 200B. The second left-corner aperture 228 may be generally rectangular in shape; however, in other embodiments, the second left-corner aperture 228 may be circular, square-shaped, etc. The second left-corner aperture 228 may pass from the upper surface of the left-corner block 200B to the lower surface thereof. The first left-corner slot 230 may be opened on the third left-corner side 202B of the left-corner block 200B, meaning the third left-corner side 202B has a gap.

Positioned within the first left-corner slot 230 may be a first left-corner member 234A and a second left-corner member 234B, both of which may be cross-webbings or supports. The first left-corner member 234A may be proximate the third left-corner side 220B and be integrated into the second left-corner inner wall 232 and an inner surface of the fourth left-corner side 222B of the left-corner block 200B. The first left-corner member 234A may be perpendicular to the second left-corner inner wall 232 and the inside of the second left-corner side 222A. The first left-corner member 234A may begin at the upper surface of the left-corner block 200B and terminate at the lower surface thereof, with the first left-corner member 234A being flush on the upper and lower surfaces. Further, the first left-corner member 234A may include a first left-corner notch 236A (e.g., a substantially v-shaped notch) with a flat bottom. The second left-corner member 234B may be proximate and define a portion of the first left-corner aperture 224 and be integrated into the second left-corner inner wall 232 and the inner surface of the second left-corner side 222A of the left-corner block 200B. Similar to the first left-corner member 234A, the second left-corner member 234B may be perpendicular to the second left-corner inner wall 232 and the inside of the second left-corner side 222A. The second left-corner member 234B may begin at the upper surface of the left-corner block 200B and terminate at the lower surface thereof, with the second left-corner member 234B being flush on the upper and lower surfaces. Further, the second left-corner member 234B may include a second notch 236B (e.g., a substantially v-shaped notch) with a flat bottom. The first and second left-corner notches 236A, 236B may increase the strength and integrity of the left-corner block 200B and be configured to receive the insulation inserts 106. In some embodiments, the notches 218A, 218B, 236A, 236B may have a depth of 3". In other embodiments, the depth of the notches 218A, 218B, 236A, 236B may be in more or less than 3", such as a range from 1"-8". While two members are shown in both the corner blocks, it will be understood that more or less than two members may be used.

Figure 13:
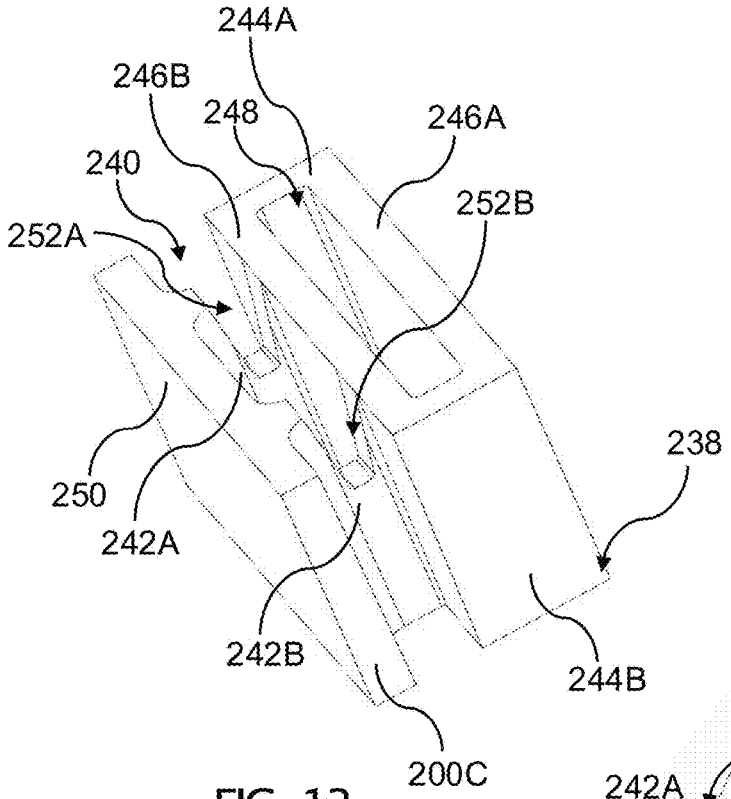
FIG. 13 illustrates a top, side perspective view of a stretcher block of an insulated dry-stacked block wall system.
Figure 14:
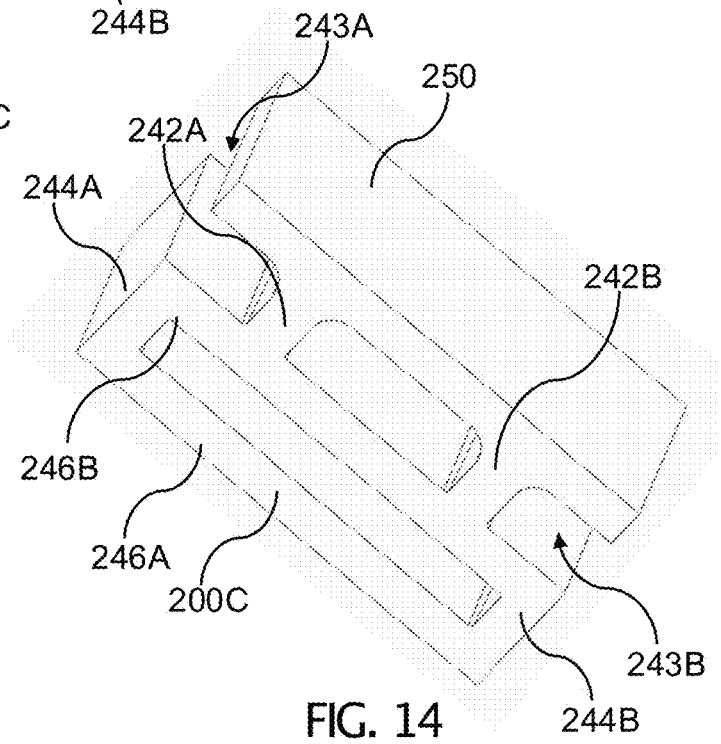
FIG. 14 illustrates a bottom, side perspective view of a stretcher block of an insulated dry-stacked block wall system.

As shown in FIGS. 13-14, the second stretcher block 200C may include a first section 238 and a second section 240. The first and second sections 238, 240 may be coupled together via a first stretcher member 242A and a second stretcher member 242B, with the stretcher members being spaced apart by a gap and having on outer sides of both members 242A, 242B channels 243A, 243B. While two stretcher members 242A, 242B are shown, it will be understood that the sections 238, 240 may be coupled with more or less than two stretcher members or may be coupled by another securement mechanism. The first section 238 may include a first stretcher side 244A, a second stretcher side 246A, a third stretcher side 244B, and a fourth stretcher side 246B. The first and third stretcher sides 244A, 244B are parallel to each other while the second and fourth stretcher sides 246A, 246B are parallel to each other. The first, second, third, and fourth stretcher walls 244A, 246A, 244B, 246B may circumscribe a stretcher block aperture 248 entirely, thereby providing structure to the stretcher block 200C and increased strength when transported and installed. The second section 240 may include a second section panel 250, and as discussed above, may be coupled to the fourth stretcher side 246B via the first and second stretcher members 242A, 242B. Similar to the other members described herein, the first stretcher member 242A may be perpendicular to an inner surface of the fourth stretcher side 246B and an inner surface of the second section panel 250. The first stretcher member 242A may begin at the upper surface of the stretcher block 200C and terminate at the lower surface thereof, with the first stretcher member 242A being flush on the upper and lower surfaces. Further, the first stretcher member 242A may include a first stretcher notch 252A (e.g., a substantially v-shaped notch) with a flat bottom. The second stretcher member 242B may be perpendicular to the inner surface of the fourth stretcher side 246B and the inner surface of the second section panel 250. The second stretcher member 242B may begin at the upper surface of the stretcher block 200C and terminate at the lower surface thereof, with the second stretcher member 242B being flush on the upper and lower surfaces. Further, the upper surface may include a second stretcher notch 252B (e.g., a substantially v-shaped notch) with a flat bottom. In some embodiments, the notches 252A, 252B may have a depth of 3". In other embodiments, the depth of the notches 252A, 252B may be in more or less than 3", such as a range from 1"-8".

Figure 15:
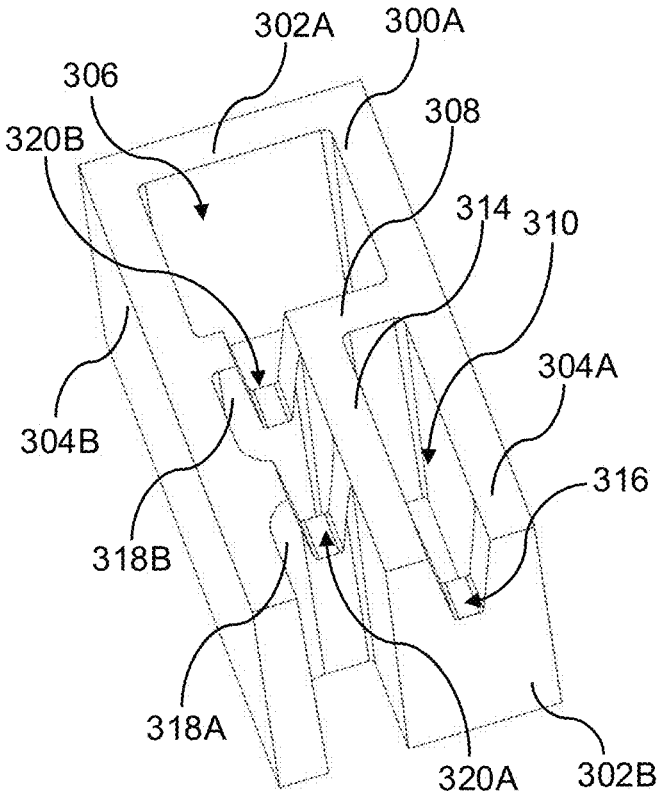
FIG. 15 illustrates a top, side perspective view of a right-corner block of an insulated dry-stacked block wall system.
Figure 16:
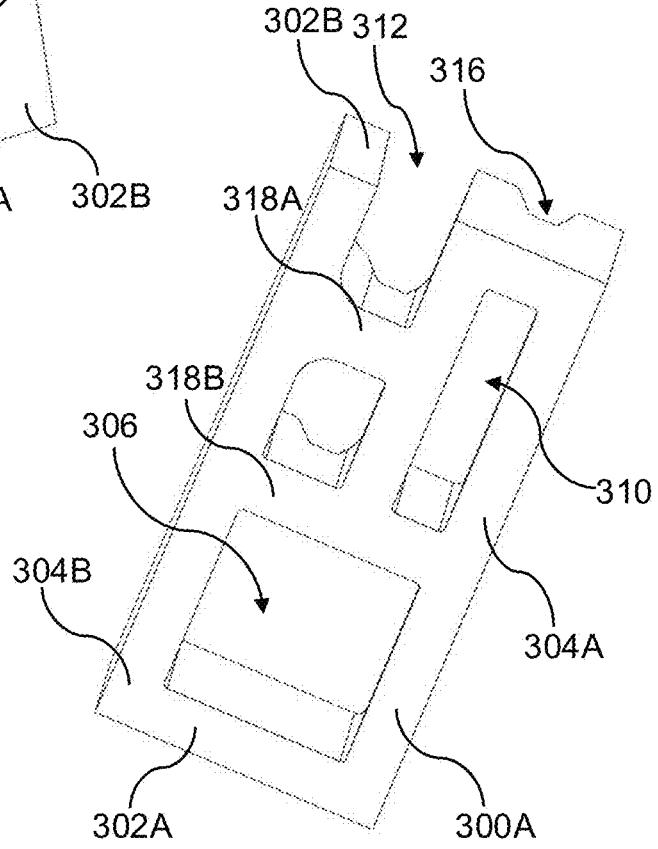
FIG. 16 illustrates a bottom perspective view of a right-corner block of an insulated dry-stacked block wall system.

As shown in FIGS. 15-20, in one embodiment, the blocks 108 (FIG. 1) may include a third right-corner block 300A, a third left-corner block 300B, and a third stretcher 300C may be used in the system 100 and replace any of the above mentioned blocks, or may be used in tandem therewith. Referring to FIGS. 15-16, the third right-corner block 300A may include a first right-corner side 302A, a second right-corner side 304A, a third right-corner side 302B, and a fourth right-corner side 304B. Proximate the first right-corner side 302A may be a first right-corner aperture 306 that passes from an upper surface of the right-corner block 300A to a lower surface thereof. The first right-corner aperture 306 may be generally square-shaped; however, other shapes for the first right-corner aperture 306 could include circular, rectangular, etc. The first right-corner aperture 306 may be defined by the first right-corner side 302A, the second right-corner side 304A, the fourth right-corner side 304B, and partially by a first right-corner inner wall 308. The first right-corner aperture 306 may be configured to receive, for example, rebar or other stabilizing shafts. Interposed between the first right-corner aperture 306 and the third right-corner side 302B may be a second right-corner aperture 310 proximate the second right-corner side 304A and a first right-corner slot 312 proximate the third and fourth right-corner sides 302B, 304B of the right-corner block 300A. The second right-corner aperture 310 may be defined by the second right-corner side 304A, the third right-corner side 302B, the first right-corner inner wall 308, and a second right-corner inner wall 314. As such, the second right-corner aperture 310 may be circumscribed by solid walls from the second right-corner side 304A, the first right-corner inner wall 308, and the second right-corner inner wall 314 from the top to the bottom of the second right-corner aperture 310, thereby increasing the strength of the right-corner block 300A. The third right-corner side 302B may include a third right-corner notch 316 that leads to the second-right-corner aperture 310. The third right-corner notch 316 may be v-shaped with a flat bottom. In some embodiments, the third right-corner notch 316 may be u-shaped, rounded on the bottom, or any other shape. The second right-corner aperture 310 may be generally rectangular in shape; however, in other embodiments, the second right-corner aperture 306 may be circular, square-shaped, etc. The second right-corner aperture 310 may pass from the upper surface of the right-corner block to the lower surface thereof. The first right-corner slot 312 may be opened on the third right-corner side 302B of the right-corner block 300A, meaning the third right-corner side has a gap.

Positioned within the first right-corner slot 312 may be a first right-corner member 318A and a second right-corner member 318B, both of which may be cross-webbings or supports. The first right-corner member 318A may be proximate the third right-corner side 302B and be integrated into the second right-corner inner wall 314 and an inner surface of the fourth right-corner side 304B of the right-corner block 300A. The first right-corner member 318A may be perpendicular to the second right-corner inner wall 314 and the inside of the fourth right-corner side 304B. The first right-corner member 318A may begin at the upper surface of the right-corner block and terminate at the lower surface thereof, with the first right-corner member 318A being flush on the upper and lower surfaces. Further, the first right-corner member 318A may include a first right-corner notch 320A (e.g., a substantially v-shaped notch) with a flat bottom. The second right-corner member 318B may be proximate and define a portion of the first right-corner aperture 306 and be integrated into the second right-corner inner wall 314 and the inner surface of the fourth right-corner side 304B of the right-corner block 300A. Similar to the first right-corner member 318A, the second right-corner member 318B may be perpendicular to the second right-corner inner wall 314 and the inside of the fourth right-corner side 304B. The second right-corner member 318B may begin at the upper surface of the right-corner block 300A and terminate at the lower surface thereof, with the second right-corner member 318B being flush on the upper and lower surfaces. Further, the second right-corner member 318B may include a second right-corner notch 320B (e.g., a substantially v-shaped notch) with a flat bottom. In some embodiments, the first and second right-corner notches 320A, 320B may be generally flat at the point of the "V" or bottom thereof, or any other shape. Other embodiments may include a notch that is generally U-shaped or other shapes. The first and second right-corner notches 320A, 320B may increase the strength and integrity of the right-corner block 300A and be configured to receive the insulation inserts 106.

Figure 17:
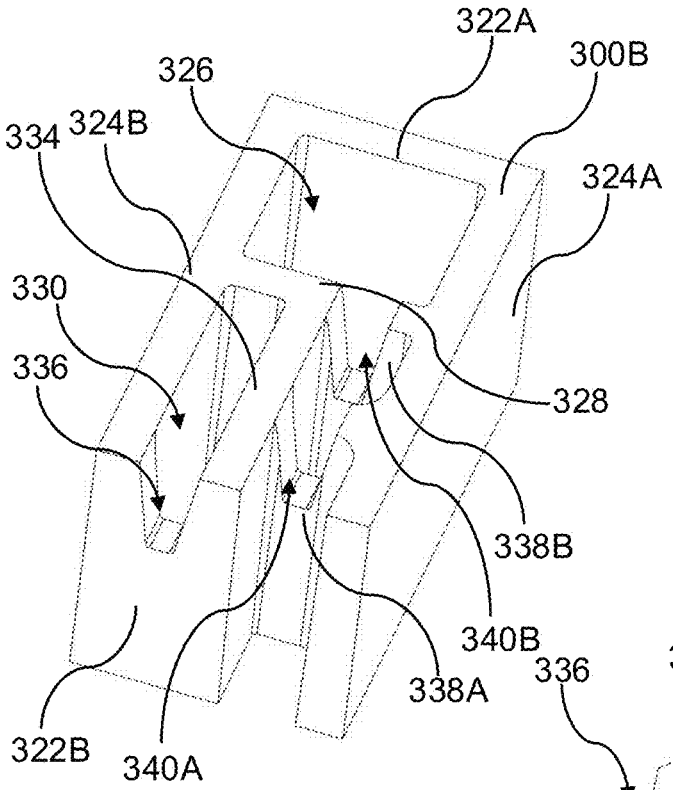
FIG. 17 illustrates a top, side perspective view of a left-corner block of an insulated dry-stacked block wall system.
Figure 18:
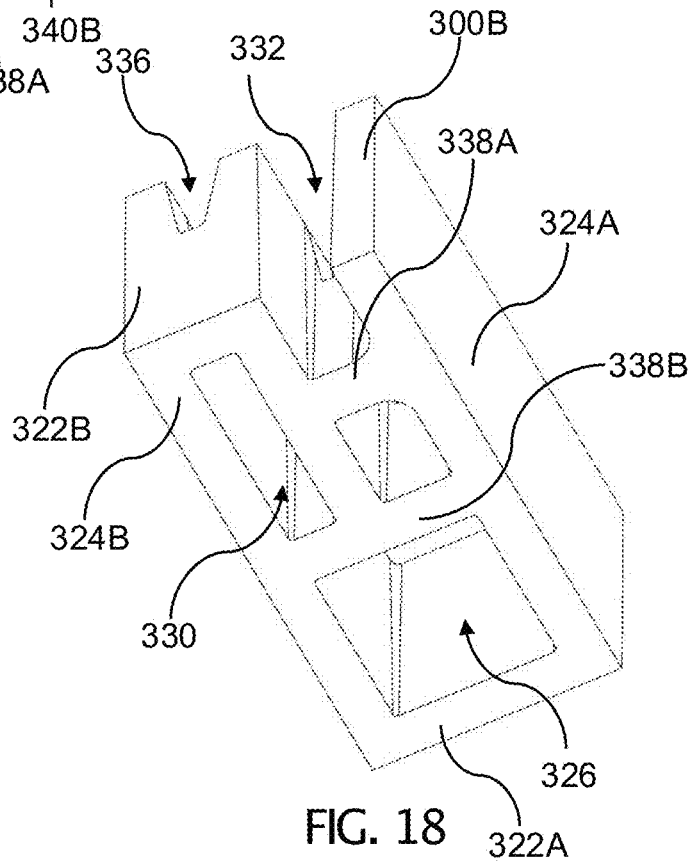
FIG. 18 illustrates a bottom perspective view of a left-corner block of an insulated dry-stacked block wall system.

As shown in FIGS. 17-18, the third left-corner block 300B may include a first left-corner side 322A, a second left-corner side 324A, a third left-corner side 322B, and a fourth left-corner side 324B. Proximate the first left-corner side 322A may be a first left-corner aperture 326 that passes from an upper surface of the left-corner block 300B to a lower surface thereof. The first left-corner aperture 326 may be generally square-shaped; however, other shapes for the first left-corner aperture 326 could include circular, rectangular, etc. The first left-corner aperture 326 may be defined by the first left-corner side 322A, the second left-corner side 324A, the fourth left-corner side 324B, and partially by a first left-corner inner wall 328. The first left-corner aperture 326 may be configured to receive, for example, rebar or other stabilizing shafts. Interposed between the first left-corner aperture 326 and the third left-corner side 322B may be a second left-corner aperture 330 proximate the fourth left-corner side 324B and a first left-corner slot 332 proximate the second and third left-corner sides 324A, 322B of the right-corner block 300B. The second left-corner aperture 330 may be defined by the fourth left-corner side 324B, third left-corner side 322B, the first left-corner inner wall 328, and a second left-corner inner wall 334. As such, the second left-corner aperture 330 may be circumscribed by solid walls from the fourth left-corner side 324B, the first left-corner inner wall 322A, and the second left-corner inner wall 334 top to the bottom of the second left-corner aperture 330, thereby increasing the strength of the left-corner block 300B. The third left-corner side 322B may include a third left-corner notch 336 that leads to the second-left-corner aperture 330. The third left-corner notch 336 may be v-shaped with a flat bottom. In some embodiments, the third left-corner notch 336 may be u-shaped, rounded on the bottom, or any other shape. The second left-corner aperture 330 may be generally rectangular in shape; however, in other embodiments, the second left-corner aperture 330 may be circular, square-shaped, etc. The second left-corner aperture 330 may pass from the upper surface of the left-corner block 300B to the lower surface thereof. The first left-corner slot 332 may be opened on the third left-corner side 322B of the left-corner block 300B, meaning the third left-corner side has a gap.

Positioned within the first left-corner slot 332 may be a first left-corner member 338A and a second left-corner member 338B, both of which may be cross-webbings or supports. The first left-corner member 338A may be proximate the third left-corner side 322B and be integrated into the second left-corner inner wall 334 and an inner surface of the fourth left-corner side 324B of the left-corner block 300B. The first left-corner member 338A may be perpendicular to the second left-corner inner wall 334 and the inside of the second left-corner side 324A. The first left-corner member 338A may begin at the upper surface of the left-corner block 300B and terminate at the lower surface thereof, with the first left-corner member 338A being flush on the upper and lower surfaces. Further, the first left-corner member 338A may include a first left-corner notch 340A (e.g., a substantially v-shaped notch) with a flat bottom. The second left-corner member 338B may be proximate and define a portion of the first left-corner aperture 326 and be integrated into the second left-corner inner wall 334 and the inner surface of the second left-corner side 324A of the left-corner block 300B. Similar to the first left-corner member 338A, the second left-corner member 338B may be perpendicular to the second left-corner inner wall 334 and the inside of the second left-corner side 324A. The second left-corner member 338B may begin at the upper surface of the left-corner block and terminate at the lower surface thereof, with the second left-corner member 338B being flush on the upper and lower surfaces. Further, the second left-corner member 338B may include a second notch 340B (e.g., a substantially v-shaped notch) with a flat bottom. In some embodiments, the first and second left-corner notches 340A, 340B may be generally flat at the point of the "V" or bottom thereof, or any other shape. Other embodiments may include a notch that is generally U-shaped or other shapes. The first and second left-corner notches 340A, 340B may increase the strength and integrity of the left-corner block 300B and be configured to receive the insulation inserts 106. In some embodiments, the notches may have a depth of 3". In other embodiments, the depth of the notches 320A, 320B, 340A, 340B may be in more or less than 3", such as a range from 1"-8". While two members are shown in both the corner blocks, it will be understood that more or less than two members may be used.

Figure 19:
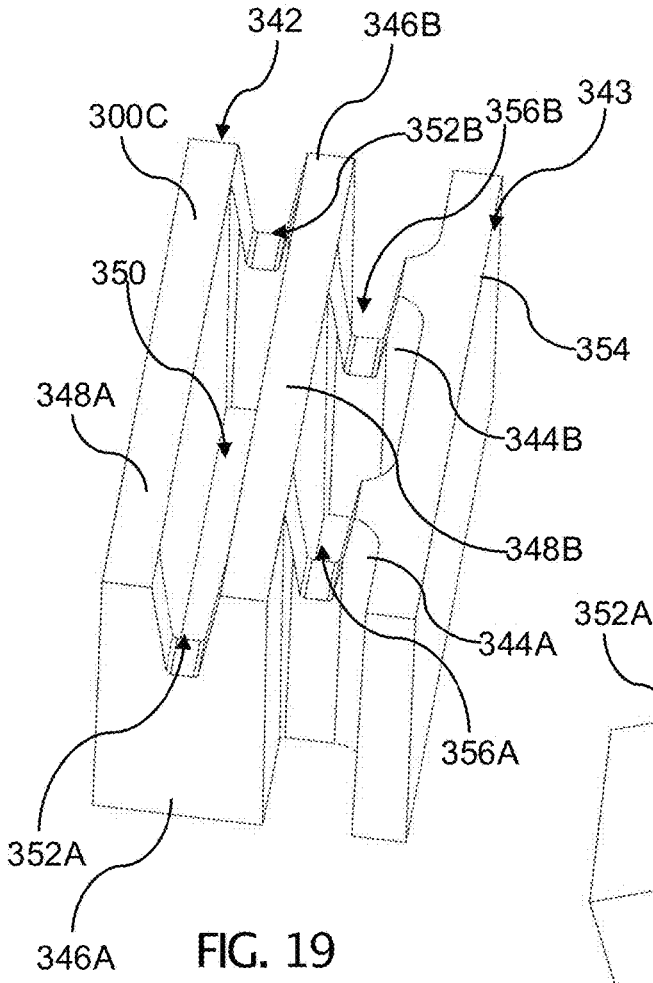
FIG. 19 illustrates a top, side perspective view of a stretcher block of an insulated dry-stacked block wall system.
Figure 20:
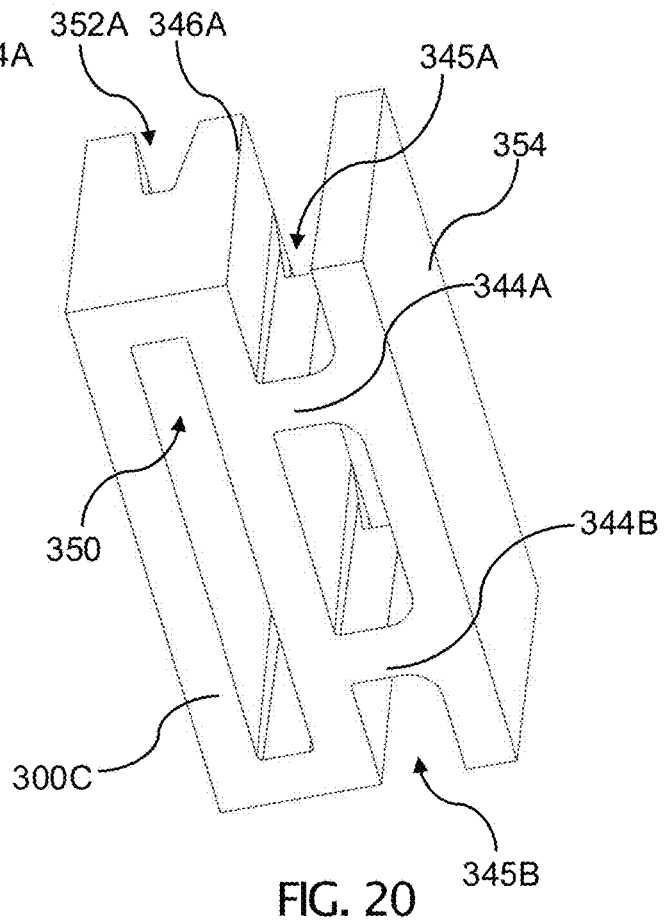
FIG. 20 illustrates a bottom perspective view of a stretcher block of an insulated dry-stacked block wall system.

As shown in FIGS. 19-20, the third stretcher block 300C may include a first section 342 and a second section 343. The first and second sections 342, 343 may be coupled together via a first stretcher member 344A and a second stretcher member 344B, with the stretcher members 344A, 344B being spaced apart by a gap and having on outer sides of both members 344A, 344B channels 345A, 345B. While two stretcher members are shown, it will be understood that the sections may be coupled with more or less than two stretcher members or may be coupled by another securement mechanism. The first section 342 may include a first stretcher side 346A, a second stretcher side 348A, a third stretcher side 346B, and a fourth stretcher side 348B. The first and third stretcher sides 346A, 346B are parallel to each other while the second and fourth parallel sides 348A, 348B are parallel to each other. The first, second, third, and fourth stretcher sides 346A, 348A, 346B, 348B may circumscribe a stretcher block aperture 350 entirely, thereby providing structure to the stretcher block 300C and increased strength when transported and installed. The first stretcher side 346A may include a first stretcher notch 352A, having a generally flat bottom. The third stretcher side 346B may include a second stretcher notch 352B, having a generally flat bottom. In some embodiments, the first and second stretcher notches 352A, 352B have a depth of 3". Furthermore, it will be understood that the first and second stretcher notches 352A, 352B may be a variety of shapes, depths, thicknesses, etc. The second section 343 may include a second section panel 354, and as discussed above, may be coupled to the fourth stretcher side 348B via the first and second stretcher members 344A, 344B. Similar to the other members described herein, the first stretcher member 344A may be perpendicular to an inner surface of the fourth stretcher side 348B and an inner surface of the second section panel 354. The first stretcher member 344A may begin at the upper surface of the stretcher block 300C and terminate at the lower surface thereof, with the first stretcher member 344A being flush on the upper and lower surfaces. Further, the first stretcher member 344A may include a first stretcher member notch 356A (e.g., a substantially v-shaped notch) with a flat bottom. The second stretcher member 344B may be perpendicular to the inner surface of the fourth stretcher side 348B and the inner surface of the second section panel 354. The second stretcher member 344B may begin at the upper surface of the stretcher block 300C and terminate at the lower surface thereof, with the second stretcher member 344B being flush on the upper and lower surfaces. Further, the upper surface may include a second stretcher notch 356B (e.g., a substantially v-shaped notch) with a flat bottom. In some embodiments, the first and second stretcher notches 356A, 356B may be generally flat at the point of the "V" or bottom thereof, or any other shape. Other embodiments may include a notch that is generally U-shaped or other shapes. In some embodiments, the notches 356A, 356B may have a depth of 3". In other embodiments, the depth of the V-shaped notches may be in more or less than 3", such as a range from 1"-8".

Figure 21:
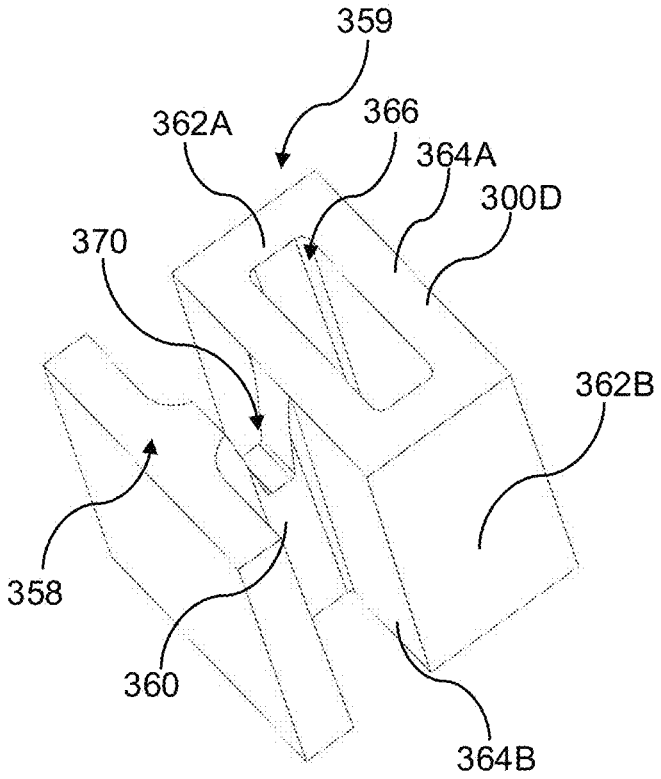
FIG. 21 illustrates a top, side perspective view of a half-stretcher block of an insulated dry-stacked block wall system.
Figure 22:
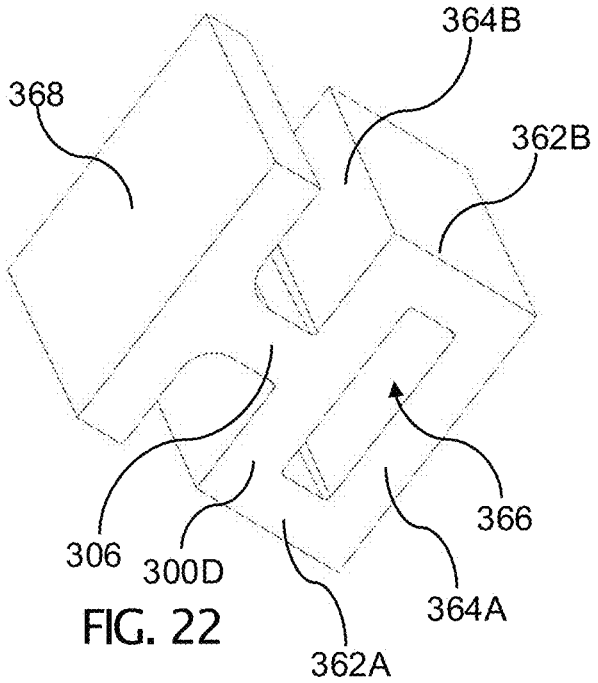
FIG. 22 illustrates a bottom perspective view of a half-stretcher block of an insulated dry-stacked block wall system.

As shown in FIGS. 21-22, a half-stretcher 300D comprises a first half-stretcher section 358 and a second half-stretcher section 359. The first half-stretcher section 358A may be coupled to the second half-stretcher section 358B via a half-stretcher member 360, which channels positioned on both sides thereof. The second section 358B may include a first half-stretcher side 362A, a second half-stretcher side 364A, a third half-stretcher side 362B parallel to the first half-stretcher side 362A, and a fourth half-stretcher side 364B parallel to the second half-stretcher side 364A, all of which define a half-stretcher aperture 366. The first half-stretcher section 358 may include the half-stretcher member 360 that may be perpendicular to an inner surface of the fourth half-stretcher side 364B and an inner surface of the first half-stretcher section 358A and, more particularly, a half-stretcher panel 368. The half-stretcher member 360 may begin at the upper surface of the half-stretcher block 300D and terminate at the lower surface thereof, with the half-stretcher member 360 being flush on the upper and lower surfaces. Further, the half-stretcher member 360 may include a half-stretcher notch 370 (e.g., a substantially v-shaped notch) with a flat bottom. As discussed above, in other embodiments, the notch 370 may be rounded, or other shapes. Furthermore, the notch 370 may have a depth of 3", but may also have a depth of more or less than three inches.

Any of the aforementioned blocks may be configured to receive rebar. In some embodiments, the rebar may be placed 48" on center both horizontally and vertically in the non-insulated block cells. A filler material, such as grout, may be used to hold the rebar in place, which provides strength to the system 100. Strengthened exterior cross-webbings on the blocks improve block strength and reduces waste during block production and construction phase, meaning less blocks are broken. Strengthened blocks also provide strengthened wall systems. The benefits include a typical 70% savings in energy efficiency; a 4+ hour fire rating; can withstand winds of 160 mph; a 0.01% permeability which means effectively watertight so no pests, rodents, termites, or other pests can hide inside the wall; an STC 61 sound rating making it as quiet as a sound recording studio.

It will be appreciated that other block configurations may be used without departing herefrom, which would include changes to the insulation inserts' shapes.

It will be understood that while various embodiments have been disclosed herein, other embodiments are contemplated. Further, systems and/or methods according to certain embodiments of the present disclosure may include, incorporate, or otherwise comprise properties or features described in other embodiments. Consequently, various features of certain embodiments can be compatible with, combined with, included in, and/or incorporated into other embodiments of the present disclosure. Therefore, disclosure of certain features or components relative to a specific embodiment of the present disclosure should not be construed as limiting the application or inclusion of said features or components to the specific embodiment unless stated. As such, other embodiments can also include said features, components, members, elements, parts, and/or portions without necessarily departing from the scope of the present disclosure.

What is claimed is:

1. An insulated dry-stacked block wall system comprising:

a plurality of blocks, the plurality of blocks comprising:

a right-corner block comprising a first right-corner side, a second right-corner side, a third right-corner side, and a fourth right-corner side, wherein the first, second, third, and fourth right-corner sides define portions of a first right-corner aperture and a second right-corner aperture and, the first, second, and fourth right-corner sides are continuous from an upper surface to a lower surface thereof;

a first right-corner member and a second right-corner member;

wherein the second right-corner member defines a portion of the first right-corner aperture;

wherein the first right-corner member comprises a first right-corner notch, and the second right-corner member comprises a second right-corner notch that leads to the first right-corner aperture;

a left-corner block comprising a first left-corner side, a second left-corner side, a third left-corner side, and a fourth left corner-side, wherein the first, second, third, and fourth left-corner sides define portions of a first left-corner aperture and a second left-corner aperture and the first, second, and fourth left-corner sides are continuous from an upper surface to a lower surface thereof;

a first left-corner member and a second left-corner member;

wherein the second left-corner member defines a portion of the first left-corner aperture;

wherein the first left-corner member comprises a first left-corner notch, and the second left-corner member comprises a second left-corner notch that leads to the first left-corner aperture; and a stretcher block comprising a first section and a second section;

insulation inserts positionable in the plurality of blocks, the insulation inserts coupling the plurality of blocks horizontally.

2. The insulated dry-stacked block wall system of claim 1, wherein right-corner block comprises a right-corner slot.

3. The insulated dry-stacked block wall system of claim 1, wherein left-corner block comprises a left-corner slot.

4. The insulated dry-stacked block wall system of claim 1, wherein the first section of the stretcher block comprises a first stretcher side, a second stretcher side, a third stretcher side, and a fourth stretcher side, all of which define a stretcher block aperture and are continuous from an upper surface to a lower surface thereof.

5. The insulated dry-stacked block wall system of claim 1, wherein the second section of the stretcher block comprises a first stretcher member with a first stretcher notch, a second stretcher member with a second stretcher notch, and a section panel.

6. The insulated dry-stacked block wall system of claim 5, wherein the first stretcher notch is substantially v-shaped or tapers from top to bottom and has a rounded or flat bottom, and the second stretcher notch is substantially v-shaped or tapers from top to bottom and has a rounded or flat bottom.

7. The insulated dry-stacked block wall system of claim 5, wherein the first stretcher member and the second stretcher member are separated by a gap that is positioned therein-between and between an inner surface of the section panel and the first section.

8. The insulated dry-stacked block wall system of claim 5, wherein a first channel is adjacent to an outer edge of the first stretcher member and a second channel is adjacent to an outer edge of the second stretcher member.

9. The insulated dry-stacked block wall system of claim 1, further comprising support shafts positionable into one or more of the plurality of blocks to stabilize the system.

10. The insulated dry-stacked block wall system of claim 1, wherein the plurality of blocks comprises a half-stretcher block.

11. The insulated dry-stacked block wall system of claim 10, wherein the half-stretcher block comprises:

a first half-stretcher section, the first half-stretcher section comprising:

a half-stretcher panel, a half-stretcher member comprising a half-stretcher notch;

a second half-stretcher section coupled to the first half-stretcher section via the half-stretcher member, the second half-stretcher section comprising:

a first half-stretcher side, a second half-stretcher side, a third half-stretcher side parallel to and spaced apart from the first half-stretcher side, a fourth half stretcher side parallel to and spaced apart from the second half-stretcher side, a half-stretcher aperture defined by the first, second, third, and fourth half-stretcher sides.

12. An insulated dry-stacked block wall system comprising:

a plurality of blocks, the plurality of blocks comprising:

a right-corner block comprising:

a first right-corner side, a second right-corner side, a third right-corner side, and a fourth right-corner side, wherein the first, second, third, and fourth right-corner sides define portions of a first right-corner aperture and a second right-corner aperture and, the first, second, and fourth right-corner sides are continuous from an upper surface to a lower surface thereof, a first right-corner member having a first right-corner notch, a second right-corner member having a second right-corner notch, wherein the second right-corner member defines a portion of the first right-corner aperture;

a left-corner block comprising:

a first left-corner side, a second left-corner side, a third left-corner side, and a fourth left corner-side, wherein the first, second, third, and fourth left-corner sides define portions of a first left-corner aperture and a second left-corner aperture and the first, second, and fourth left-corner sides are continuous from an upper surface to a lower surface thereof, a first left-corner member having a first right-corner notch, a second right-corner member having a second right-corner notch, wherein the second left-corner member defines a portion of the first left-corner aperture;

a stretcher block comprising:

a first section, the first section comprising a first stretcher side, a second stretcher side, a third stretcher side, and a fourth stretcher side, all of which define a stretcher block aperture and are continuous from an upper surface to a lower surface thereof;

a second section, the second section comprising a first stretcher member with a first stretcher notch, a second stretcher member with a second stretcher notch, and a section panel;

insulation inserts positionable in the plurality of blocks, the insulation inserts coupling the plurality of blocks horizontally.

13. The insulated dry-stacked block wall system of claim 12, wherein the first and second right-corner notches, the first and second left-corner notches, and the first and second stretcher notches are substantially tapered with a rounded bottom at the narrowest section of the taper or substantially tapered with a flat bottom at the narrowest section of the taper.

14. The insulated dry-stacked block wall system of claim 12, wherein the third right-corner side comprises a right-corner notch, and the third left-corner side comprises a left-corner notch.

15. The insulated dry-stacked block wall system of claim 12, wherein the first stretcher side comprises a first stretcher notch, and the third stretcher side comprises a second stretcher notch.

16. The insulated dry-stacked block wall system of claim 12, wherein a depth of the first and second right-corner notches, the first and second left-corner notches, and the first and second stretcher notches is in a range from 2 inches to 6 inches.

17. The insulated dry-stacked block wall system of claim 12, further comprising an interior finish and an exterior finish, wherein the interior finish is applied to the interior structure coat and the exterior finish is applied to the exterior structure coat.

18. An insulated dry-stacked block wall system comprising:

a plurality of blocks, the plurality of blocks comprising:

a right-corner block comprising a first right-corner side, a second right-corner side, a third right-corner side, and a fourth right-corner side, wherein the first, second, third, and fourth right-corner sides define portions of a first right-corner aperture and a second right-corner aperture and, the first, second, and fourth right-corner sides are continuous from an upper surface to a lower surface thereof;

a left-corner block comprising a first left-corner side, a second left-corner side, a third left-corner side, and a fourth left corner-side, wherein the first, second, third, and fourth left-corner sides define portions of a first left-corner aperture and a second left-corner aperture and the first, second, and fourth left-corner sides are continuous from an upper surface to a lower surface thereof; and a stretcher block comprising:

a first section, the first section comprising a first stretcher side, a second stretcher side, a third stretcher side, and a fourth stretcher side, all of which define a stretcher block aperture and are continuous from an upper surface to a lower surface thereof;

a second section, the second section comprising a first stretcher member with a first stretcher notch, a second stretcher member with a second stretcher notch, and a section panel;

a half-stretcher block comprising:

a first half-stretcher section, the first half-stretcher section comprising:

a half-stretcher panel, a half-stretcher member comprising a half-stretcher notch;

a second half-stretcher section coupled to the first half-stretcher section via the half-stretcher member, the second half-stretcher section comprising:

a first half-stretcher side, a second half-stretcher side, a third half-stretcher side parallel to and spaced apart from the first half-stretcher side, a fourth half stretcher side parallel to and spaced apart from the second half-stretcher side, a half-stretcher aperture defined by the first, second, third, and fourth half-stretcher sides;

insulation inserts positionable in the plurality of blocks, the insulation inserts coupling the plurality of blocks horizontally;

an exterior structure coat applied to the plurality of blocks;

an interior structure coat applied to the plurality of blocks; and an interior finish and an exterior finish, wherein the interior finish is applied to the interior structure coat and the exterior finish is applied to the exterior structure coat.

* * * * *